US005732682A

United States Patent [19]

Petersson

[11] Patent Number: 5,732,682

[45] Date of Patent: Mar. 31, 1998

[54] FUEL AMOUNT CONTROL

[75] Inventor: Ulf Petersson, Tollered, Sweden

[73] Assignee: Aktiebolaget Electrolux, Stockholm, Sweden

[21] Appl. No.: 737,179

[22] PCT Filed: May 5, 1995

[86] PCT No.: PCT/SE95/00498

§ 371 Date: Nov. 1, 1996

§ 102(e) Date: Nov. 1, 1996

[87] PCT Pub. No.: WO95/30828

PCT Pub. Date: Nov. 16, 1995

[30] Foreign Application Priority Data

May 5, 1994 [SE] Sweden ..... 9401554

[51] Int. Cl.[6] ..... F02M 7/12

[52] U.S. Cl. ..... 123/508; 261/DIG. 21

[58] Field of Search ..... 123/508, 504, 123/437, 438, 434; 261/DIG. 21, DIG. 23

[56] References Cited

U.S. PATENT DOCUMENTS

| | | | |
|---|---|---|---|
| 1,123,508 | 1/1915 | Farrell | 261/DIG. 21 |
| 1,371,562 | 3/1921 | Kent | 261/DIG. 21 |
| 2,955,582 | 10/1960 | Taylor et al. | 123/508 |
| 4,411,233 | 10/1983 | Chenet et al. | 123/494 |
| 4,577,597 | 3/1986 | Tomita | 123/73 A |
| 4,944,275 | 7/1990 | Perr | 123/508 |

FOREIGN PATENT DOCUMENTS

| | | | |
|---|---|---|---|
| 23 48 638 | 8/1978 | Germany . | |
| 70985 | 2/1927 | Sweden | 123/508 |
| 1445849 | 8/1976 | United Kingdom . | |
| 2028431 | 3/1980 | United Kingdom . | |

OTHER PUBLICATIONS

The Automobile, Feb. 4, 1915, M.F. Carbureter Is Floatless, Feb. 1915.

*Primary Examiner*—David A. Okonsky

*Attorney, Agent, or Firm*—Pearne, Gordon, McCoy & Granger LLP

[57] ABSTRACT

A method and a device of controlling the amount of fuel delivered to a combustion engine (1), e.g. of two-stroke or four-stroke type, wherein the fuel is supplied through an intake passage (2) intended to deliver air (3) and fuel (4) to the cylinder (5), said intake passage being opened and closed by a piston (6) or by a special valve (7). The fuel supply to the intake passage (2) is effected upstream from the piston (6) or the valve (7) and in response to the opening and closing of the intake passage (2) varying flow speeds and pressures are produced in the passage and the fuel supply system (8) is of a kind the supply amount of which is substantially affected by this variation, such as a carburetor (9) or a low-pressure injection system (10). In order to regulate the fuel supply to the engine fuel a brief cut-off takes place in the fuel-supply system (8) of the entire fuel flow or the part flow and the brief cut-off is arranged to take place to an essential extent during a part of the engine revolution when the intake passage is closed and the fuel supply accordingly is reduced or has ceased.

13 Claims, 4 Drawing Sheets

Fig. 3a
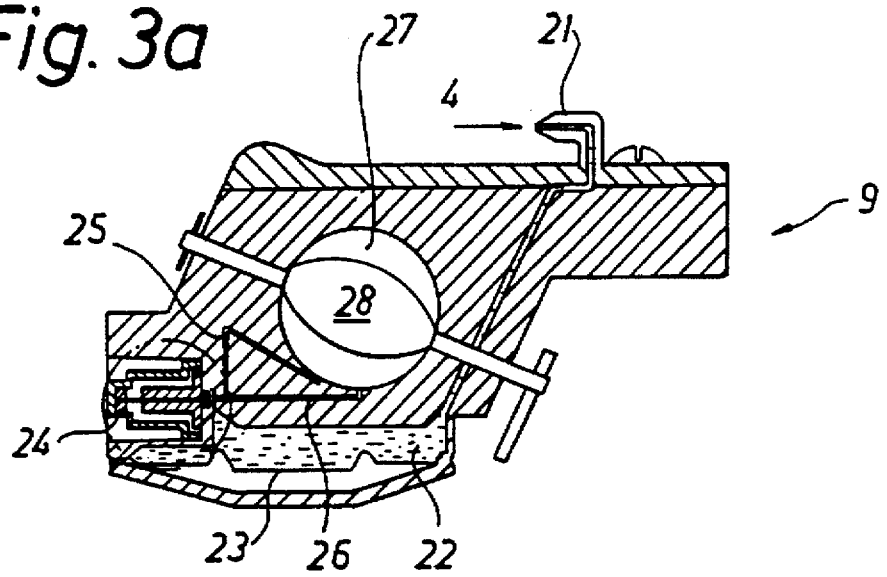
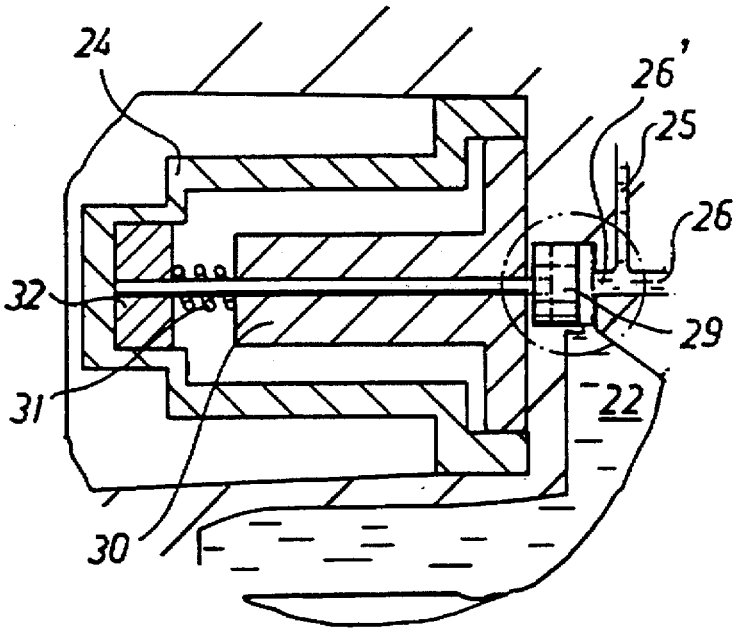
Fig. 3b
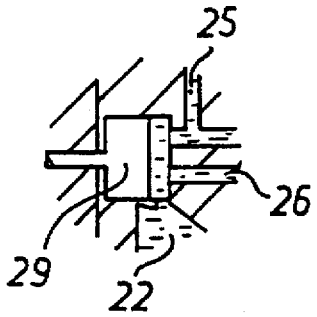
Fig. 3c 0
1
2
3
R
B
b
C
D
A
a
S
A'
a'
F1
33
34
35
F2
F1,F2
G
P
H
h
E
F
g
H'
G'
36
S'

FUEL AMOUNT CONTROL

TECHNICAL FIELD

The subject invention concerns a method and a device to control the amount of fuel delivered to an internal combustion engine to which the fuel is supplied through an intake passage intended to deliver air and fuel to the cylinders. The intake passage is opened and closed by the piston or by a special valve, and the fuel supply system is of the type the supply amount of which is substantially affected by said opening and closing, e.g. a carburettor or a low-pressure injection system.

BACKGROUND OF THE INVENTION

Internal combustion engines of two-stroke or four-stroke type usually are equipped with a fuel supply system of carburettor type or injection type. In a carburettor, the throttle of the carburettor is affected by the operator's demand, so that wide open throttle produces a minimum throttling in the carburettor barrel. The depression created by the passing air in the carburettor venturi draws fuel into the engine. Traditionally, carburettor engines are equipped with stationary nozzles or manually adjustable nozzles to regulate the degree of richness/leaness of the air-fuel mixture. As the demands on lower fuel consumption jointly with demands on cleaner exhaust have increased also electronically controlled nozzles have been suggested. In the latter case the amount of fuel supplied to the carburettor barrel is adjusted. This is effected with the aid of variable throttling. Increasing throttling gives a leaner air-fuel mixture. The throttling is regulated continuously or in small steps. However, such quantity adjustment is comparitively complicated and expensive. It is already known to provide for a brief cut-off during the suction phase in order to reduce the amount of fuel or, in accordance with the teachings of DE 23 48 63S, to briefly open a normally closed valve during the suction phase. It is very difficult to rapidly open and close a valve, or vice or vice versa, with accuracy. The carburettor is positioned in an intake passage leading to the engine cylinder. This intake passage is opened and closed by the engine piston or by a particular valve, usually called suction valve. Owing to this opening and closing of the intake passage varying flow speeds and pressures generate inside the passage. Since the carburettor is constructed to allow the depression in the carburettor barrel to draw in fuel, also the amount of fuel supplied will be largelly affected by the closing and the opening of the intake passage. One consequence of the closing of the intake channel is that the active depression initially disappears. However, the rapid closure causes an oscillation to be produced in the intake passage, resulting in an active depression again generating in the carburettor barrel once or several times after closure of the intake passage. Consequently, one or several fuel feeds occur. Such fuel feeds are not desirable since they do not correspond to an actual air flow through the carburettor barrel. The basic function of the carburettor is to add an appropriate amount of fuel to a predetermined amount of passing air. To a certain extent this oscillation phenomenon may be considered in the calibration of the carburettor but since the oscillation is affected by several factors and changes in response to the engine speed such oscillation results in a less precise fuel supply to the intake passage. This argumentation applies primarily in the case of carburettor engines wherein the fuel supply is effected through an intake passage which is opened and closed. But also in fuel injection systems of low-pressure type the injectioned amounts are greatly affected by pressure variations inside the intake passage.

PURPOSE OF THE INVENTION

The purpose of the subject invention is to considerably lessen the above-mentioned problems by providing a method and a device to regulate the amount of fuel supplied to an internal combustion engine equipped with fuel supply systems of the above type, so as to ensure simple, safe and reliable fuel amount supply.

SUMMARY OF THE INVENTION

The above purpose is achieved by means of a method and a device in accordance with the invention having the characteristics appearing from the appended claims.

Accordingly, the method in accordance with the invention is characterized primarily in that in the fuel supply system cut-off is effected during a part of the operating cycle by means of a shut-off valve cutting off the entire fuel flow or a part flow, and in that the cut-off is arranged to take place to an essential extent during a part of the operating cycle when the intake passage is closed and consequently the feed of fuel is reduced or has ceased. Owing to this shut-off the amounts of fuel supplied in consequence of the above oscillation phenomenon in the intake passage may be eliminated which is a definite advantage. In addition, a prolonged cut-off period need only moderately affect the amount of fuel supplied. A valve may be more easily opened and closed accurately if such actions need not take place very rapidly. By starting and/or finishing the closure of the shut-off valve in a precisely defined position with respect to the opening and closing of the intake passage it becomes possible to precision-regulate the amount of fuel supplied.

The following description of various embodiments clearly illustrate the manner in which the regulation of amounts is effected and also the various particularities and advantages of the invention. The reading is supported by drawing figures and diagrams. The invention is primarily applicable in fuel supply systems of carburettor type, as these operate at very low fuel supply pressures. However, the invention is also applicable to fuel injections systems of low-pressure type.

BRIEF DESCRIPTION OF THE DRAWING FIGURES

The invention will be described in the following in closer details by means of various embodiments thereof with reference to the accompanying drawings wherein identical numeral references have been used in the various drawing figures to denote corresponding components.

FIG. 3*a* illustrates schematically a carburettor intended to be incorporated in a fuel supply system in accordance with the invention.

FIG. 3*b* is in a part enlargement of an area illustrated in FIG. 3*a* by means of dash- and dot lines.

FIG. 3*c* illustrates an alternative embodiment of the part solution of FIG. 3*b*, illustrated by means of a circle delimited by a dash- and -dot line.

Figure 4:
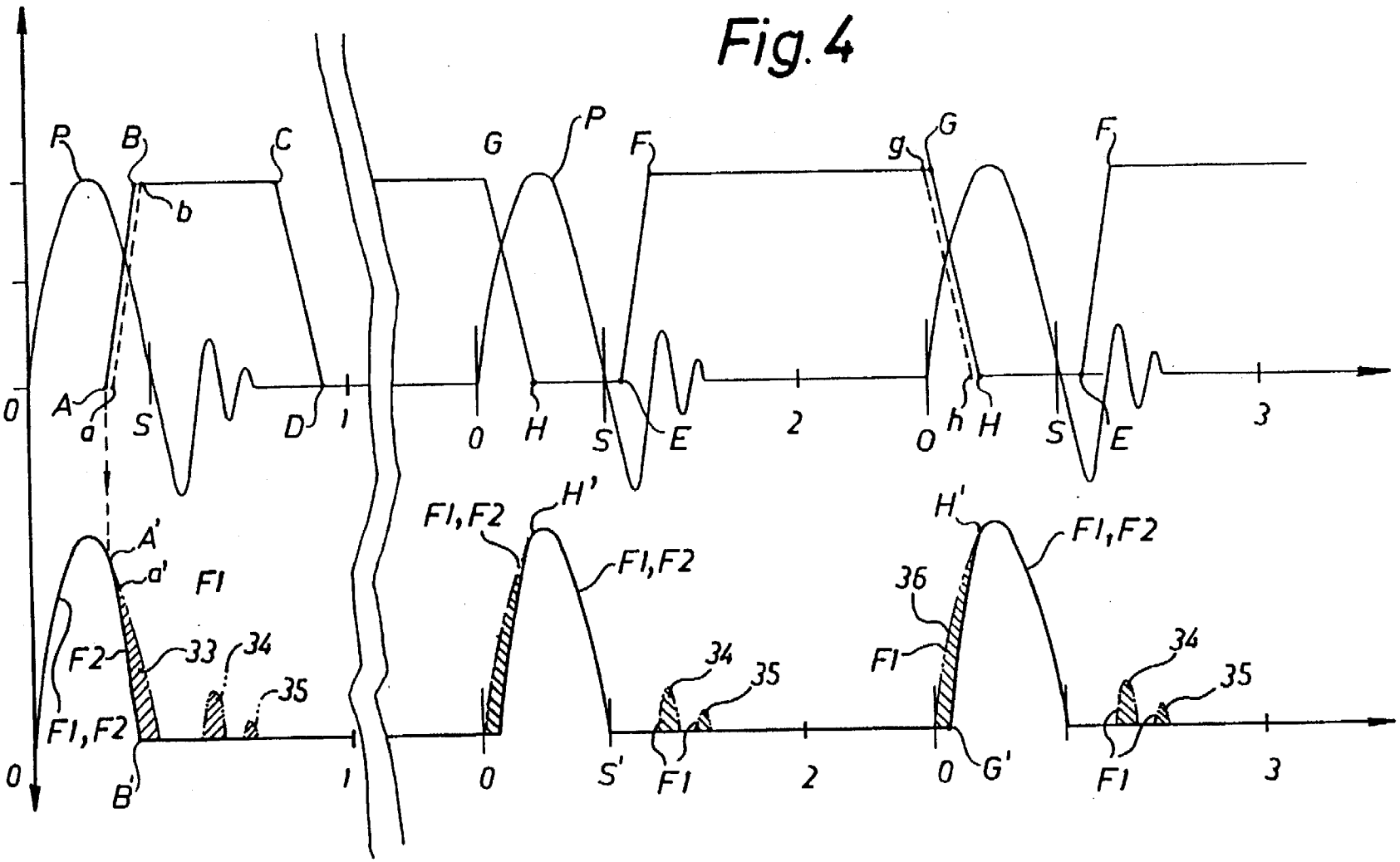

FIG. 4 illustrates, by means of the upper row of curves the operative pressures, i.e. the fuel drawing pressures and the positions of to the shut-off valve. The row below illustrates two curves representative of the resulting fuel flow, one with respect to the flow when a shut-off valve is not in operation and the other one when a shut-off valve is in operation.

DETAILED DESCRIPTION OF PREFERRED EMBODIMENTS

Figure 1:
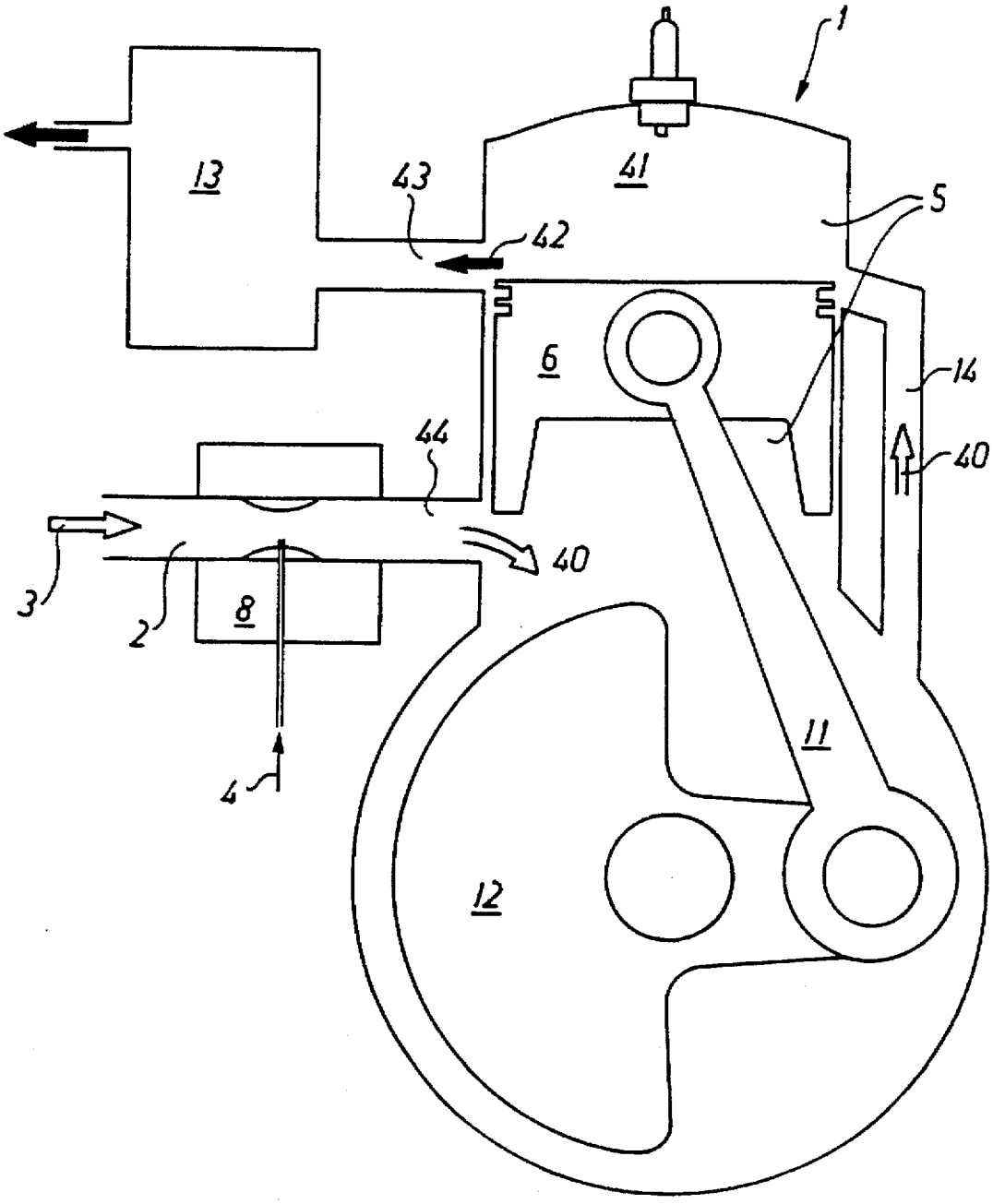
FIG. 1 is a schematical illustration of an internal combustion engine of two-stroke type in which the method and the device according to the invention have been applied.

In the schematically illustrated drawing FIG. 1 numeral reference 1 designates an internal combustion engine of a two-stroke type. It is crank case scavenged, i.e. a mixture 40 of air 3 and fuel 4 from a carburettor 9 or a low pressure fuel injection system 10 is drawn to the engine crank house. From the crank house, the mixture is carried through one or several scavenging passages 14 up to the engine combustion chamber 41. The chamber is provided with a spark plug igniting the compressed air-fuel mixture. Exhausts 42 exit through the exhaust port 43 and through a silencer 13. All these features are entirely conventional in an internal combustion engine and for this reason will not be described herein in any closer detail. The engine has a piston 6 which by means of a connecting rod 11 is attached to a crank portion 12 equipped with a counter weight. In this manner the crank shaft is turned around. In FIG. 1 a piston 6 assumes an intermediate position wherein flow is possible both through the intake port 44, the exhaust port 43 and through the scavenging passage 14. The mouth of the intake passage 2 into the cylinder 5 is called intake port 44. Thus the intake passage is closed by the piston 6. By opening and closing the intake passage 2 varying flow speeds and pressures are created inside the passage. These variations largely affect the amount of fuel 4 supplied when the fuel supply system 8 is of carburettor type 9 or is a low-pressure injection system 10. Such a fuel injection system normally operates at a pressure of two to three bars and said pressure variations then give rise to a considerable change of the amount of fuel. A carburettor has an insignificant fuel feed pressure. The amount of its fuel feed is entirely affected by pressure changes in the intake passage 2. High-pressure injection systems, on the other hand, may operate at pressures of 100 bars and in that case the effects are almost negligable. The subject invention makes use of these fuel amount variations in order to create simple and safe control of the amount of fuel supplied and it is therefore directed primarily to the fuel supply system the supplied amounts of which are essentially affected by the varying flow speeds and pressures inside the intake passage that are caused by the opening and the closing of the latter.

Figure 2:
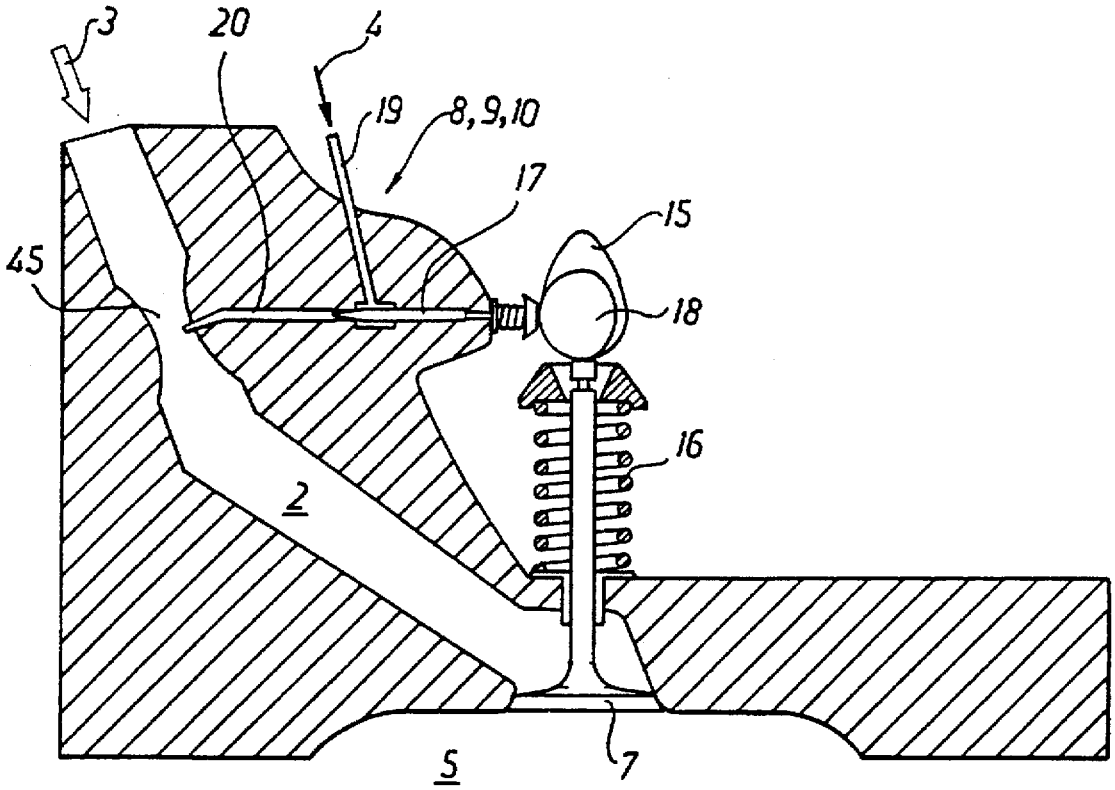
FIG. 2 illustrates a fuel injection system in accordance with the invention, intended primarily for a four-stroke engine.

FIG. 2 illustrates a fuel supply system 8 which is of a low pressure injection system type 10 or of carburettor type 9. In the latter case the carburettor 9 is located upstream of the fuel supply line 19. The drawing figure is a cross-sectional view through the cylinder head of an internal combustion engine. The cylinder head delimits the combustion chamber 5 of the engine in a direction downwards. The cross-sectional view is taken in such a manner that the intake passage and the value 7 that opens and closes the passage 2 are clearly indicated. The engine may be of a four-stroke or a two-stroke type, usually however it is of a four-stroke type. The opening and closing movements of the valve 7 are controlled by a cam shaft having a protrusion 15 affecting the valve stem. This solution is entirely conventional and for this reason will not be dealt with any further herein. On the other hand, an additional protrusion 18 is formed on the cam shaft, affecting a metering needle 17 in the fuel supply system 8. In this manner the metering needle 17 is opened and closed upon each turn of the cam shaft. In other words, the metering needle 17 acts as a shut-off valve cutting off fuel supply to the intake passage 2. Fuel is carried through a first fuel line 19 up to the metering needle 17 and from the latter through the fuel line 20 debouching into a venturi 45. The latter is a narrow part of the intake passage 2. Owing to the narrow configuration the flow speed of the air 3 is increased and thus a suction force is generated at the mouth of the fuel line 20. Owing to the supply pressure of the fuel 4 and this suction force, fuel is supplied to the intake passage 2. Because the valve 7 is opened and closed varying flow speeds and pressures are created inside the intake passage, like in the case of the piston-operated intake passage 2 in FIG. 1. Obviously the relative values of the depression in the venturi area drawing fuel and the supply pressure 4 may be varied considerably within the scope of the invention. For instance, in case of a total absence of a venturi arrangement in combination with a simultaneous low supply pressure with respect to the fuel 4, the fuel-supply amounts in the intake passage 2 would still be substantially affected by closure and opening of the valve 7. Normally, depression variations amount to some or some tenths of a bar and the supply pressure perhaps to 2 to 3 bars in the case of a low pressure system. It could also be noted that the cut-off could also related to a part flow of fuel 4. In this case there is parallel injection of fuel and this is not affected by a valve 7. Cut-off of fuel supply 4 to the intake passage 2 is affected during a part of one revolution of the engine and essentially takes place during a part of the engine revolution during which the intake passage is closed and consequently the feed of fuel is reduced or has ceased. In this manner simple and efficient fuel amount control is obtained as will be explained in more detail in connection with drawing FIG. 4.

FIG. 3*a* illustrates a carburettor to be used with the fuel supply system in accordance with the invention. Supply of fuel 4 is effected to fuel nippel 21 on a carburettor 9. From this nippel fuel is carried to a fuel storage 22 which is delimited downwards by a membrane 23. So far the carburettor is a conventional membrane carburettor and therefore need not be commented upon further. Also other types of carburettors that are arranged to supply fuel in a similar manner for further treatment are possible.

FIG. 3*b* illustrates on an enlarged scale the manner in which this further treatment after the fuel storage 22 is effected. From the storage 22 a line leads to a cut-off valve 24. The latter is in the form of a solenoid or electromagnet. Upon energization, a closure plunger 29 is forced forwards, closing off the interconnection between the storage 22 and the fuel lines 26', 26, 25 leading to the venturi in the carburettor. A compression spring 34 ensures that the closure plunger is pulled back and opens up the passage as soon as the energization ceases. The closure plunger 29 is attached to a piston rod travelling in a guide 30 and at the opposite face of the piston rod is arranged e.g. an iron core which is attracted by an energized coil so as to be moved outwards. In other words, the solenoid is of a normally open type. However, it goes without saying that it could also be of a normally closed type. In the latter case the closure plunger 29 opens up the fuel passage as the solenoid is energized. Decisive in this choice are features such as current consumption, functional reliability and so on. By choosing a normally open type it is precisely the functional reliability that is increased. For, should the energization fail, the basic function of the fuel supply system still remains. Only the finer adjustment of the fuel supply amount ceases. Downstream of the closure plunger 29 a short passage 26' leads to a branch of a wider channel 26 and smaller channel 25. The smaller channel 25 leads to the venturi and is used as a so called idling nozzle whereas the coarser channel 26 also leads to the venturi and is used as the principal nozzle. This is in analogy with conventional carburettor technology. However, the design may lead to a certain disadvantage in cases when an increase of the rotational speed takes place from an idling situation. For in such cases, fuel might be drawn back from the channel 25 and into the channel 26, whereby a surplus amount of fuel is supplied through the principal nozzle. This means that also after the closure plunger 29 having cut-off the supply from the storage 22 the fuel amount is available both in channel 25 and channel 26 to be sucked through both nozzles. Normally, this is effected through the principal nozzle. This effect may, however, be avoided with the aid of the solution according to FIG. 3*c*, which is an enlargement of the encircled area in FIG. 3*b*. In this case the short fuel line 26' is omitted. Instead, both channel 25 and channel 26 debouch into the cavity in which the closure plunger 29 operates. When in this case the closure plunger is moved forwards for closing purposes both channel 25 and 26 are closed and therefore no fuel from channel 25 can be sucked out through the channel 26 up to the principal nozzle. Also in the case of carburettors it may be appropriate to close off only a part flow with the aid of the shut-off valve 24. This solution could be of interest when the invention is used in four-stroke engines and the intake passage 2 leads directly into the engine combustion chamber. In this case there is no buffer capacity in the crank case and the change with respect to the brief cut-off of the fuel flow will become much more abrupt.

As mentioned above the invention aims at providing for improvements in several respects. This will become most clearly apparent through an examination of the graphs in FIG. 4 in which the various curves illustrate the effects on fuel flow from the actuation of the closure valve in various cases in a two-stroke engine. The upper part of the drawing figure illustrates curves P relating to an operative depression situation, i.e. the pressure drawing fuel into the intake passage 2. This depression P is a combination of the static and the dynamic pressures. The horizontal axis illustrates the crank angle position expressed as engine revolutions. Along the axis the positions with respect to opening O and closing S of the intake passage 2, respectively are marked. Opening and closure are effected either with the aid of the piston 6 or with the aid of a special valve 7. It should be observed that the axis representative of the engine revs is broken immediately following one engine revolution. To the left of the break is shown one fuel flow control variety and to the right another one. In conjunction with the upper pressure curve P is also illustrated a curve of square configuration, illustrating the manner in which the brief closure of fuel supply is effected. The examples of FIG. 4 are representative of the case in which the fuel supply is cut off completely since this is the situation most easy to discuss. But also the complete closure of a part flow could be intended, like previously. In positions A, D at the bottom of the engine revolution axis the fuel supply is fully open, i.e. the cut-off valve 24; 17 is open. At points B, C and therebetween is, on the other hand the valve is fully closed. The distance A–B illustrates the manner in which the valve moves from open to closed and C–D from closed to open. This concerns the variety of control to the left of the break in the curve. In accordance with the variety to the right of the break the square curve has been moved back in relation to the P-curve and it has also been partly prolonged. Opening and closing of the fuel supply is effected in analogy therewith according to E–F–G–H. A further condition with respect to the curves in FIG. 4 is that the fuel feed is affected solely on account on the effective depression P. This is a typical case in most carburettor applications. Quite simply, these are constructed in such a manner that the amount of passing air is to determine the fuel amount. In a low pressure injection system 10 the conditions are somewhat different but also in that case the supplied fuel amount is affected to an essential degree by changes in the operative pressure. Accordingly, the same control principles apply as in the case of a carburettor. Closure curves A–B–C–D and E–F–G–H in reality have somewhat rounded "corners" B, C, F, and G.

The left hand side of the diagram illustrates how the operative depression P increases from zero at point O, where the intake passage 2 is opened, to a maximum point then again back to zero at point S where the intake passage 2 is being closed. After closure, the depression sinks on the negative side. This means that a slight over-pressure resides in the intake passage at the position of fuel injection. The pressure then oscillates back in such a manner that thereafter a depression pulse is generated and another over-pressure pulse, followed by a slight depression pulse. This is of course only a pedagogical example but must be regarded as rather normal situation in the process. Thus, closure of the intake passage 2 results in a process of oscillation of the operative pressure. Straight below the curve representative of the operative pressure is shown a curve that is representative of the resulting fuel flow in two cases. The dotted line illustrates the case F1 when there is no cut-off of the fuel supply, i.e. no closure function according to curves A–B–C–D or E–F–G–H. In this case it is assumed that the resulting fuel flow is directly proportional to the operative pressure, which is a common situation. This means that the dash- and dot curve F1 is exactly similar to curve P up to point S. Since an over-pressure in the fuel nozzle cannot produce supply of fuel back into the carburettor nozzle no negative fuel flow may exist, i.e. fuel flow becomes zero when the P-curve is negative. On the other hand, as soon as curve P becomes positive, fuel delivery is effected. This results in the two "peaks" 34, 35. In the diagram this fuel flow curve thus is designated by F1.

When on the other hand cut-off of the fuel flow according to A–B–C–D or E–F–G–H occurs, the fuel flow is changed. This is illustrated by the continuous-line curve F2. From point O further to the left these curves are identical up to point A'. For in point A in the upper diagram the shut-off valve begins to close, which results in throttling of the fuel flow, resulting in curve F2 having a different progress from curve F1. In point B complete cut-off of the fuel flow is achieved and this corresponds to point B' in the lower diagram. At point B' fuel flow thus is zero. By cutting off the fuel flow according to curve A–B–C–D fuel flow thus has been reduced correspondingly, primarily by area 33 in the drawing figure. But also the "peaks" 34 and 35 have disappeared. This is due to the fact that the fuel supply is completely cut off during progress B–C. Fuel amounts corresponding to areas 33, 34 and 35 consequently have disappeared owing to the fuel cut-off according to A–B–C–D. This corresponds to the left-hand control variety in the drawing figure and the same applies to the right hand side. Two aspects are of interest. In the first place the "peaks" 34 and 35 disappear. This is positive since the "peaks" 34 and 35 are caused solely by a pressure oscillation in the intake passage 2. When the passage is closed there is no real air flow therein that could motivate a corresponding fuel flow. Conventional carburettors are calibrated so as to consider the "peaks" 34 and 35 as far as possible. Obviously, the number of "peaks" could be both larger than two or less than two. However, such calibration is difficult and uncertain, since the oscillation phenomon is affected by several factors and changes with the rotational speed. The removal of this "peaks" thus has resulted in more accurate fuel supply. At the same time it is also desirable to add fuel to an air flow, allowing the fuel drops to be carried straight into the engine. For several reasons it is thus desirable to remove these two "peaks" 34 and 35.

The cut-off curve representative of fuel flow shows a dotted line a–b which is essentially parallel to A–B. By instead using cut-off curve a–b–C–D the size of area 33 could be reduced. Point a, representative of the instance when the cut-off valve begins closing, in this case instead corresponds to point a' and in the example shown the area 33 is reduced approximately by half. This means that a larger amount of fuel is added in this case. Precisely by varying the position of the front flank A–B it becomes possible to control the amount of fuel supply. Cut-off of the entire fuel flow or of a part flow is arranged to occur essentially during a part of an engine revolution when the intake passage is closed, i.e. between points S–O in the diagram. Fuel amount control thus is effected by varying one flank in the cut-off curve. In the first case it is flank A–B, i.e. the front flank, that is varied. In the second case, shown to the right of the break, it is instead the rear flank G–H that is varied. In both cases the cut off curve is arranged in such a way that it affects only one side of each fuel supply progress from point O to point S, i.e. opening and closure of the intake passage 2. This is an advantageous accuracy feature, since any tolerance displacement of the cut-off curve in any direction then will only affect one of the two neighbouring fuel supply progresses. Obviously the principle may also be applied in such a way that this influence occurs on both sides of each fuel supply progress between points O and S. The first case of control to the left thus is characterized by the fact that a brief cut-off of the entire fuel flow or of a part flow is started before the intake passage 2 is closed by the piston 6 or the valve 7, i.e. in point S. The cut-off has essentially ceased before opening of the intake passage 2 is again started by the piston or by the valve 7, i.e. in point O. In accordance with the other control variety to the right of the break the cut-off begins only after closure of the intake passage 2 by the piston 6 or the valve 7, i.e. in point S. The cut-off ceases entirely only after opening of the intake passage having again begun by means of the piston 6 or the valve 7. i.e. in point O.

The basic feature of this control principle thus is that a comparatively long cut-off in time is made and this cut-off is arranged to essentially take place during a portion of one engine revolution, or more precisely working cycle, when the intake passage is closed and consequently the fuel supply is reduced or has ceased. This means that the amount of fuel supplied can be precision-adjusted by a slight displacement of one of the flanks of the shut-off valve cut-off curve. A common feature of each one of the control situations is that a change of the state of the shut-off valve 24; 17, i.e. from closed to open or alternatively from open to closed, is arranged to essentially take place within the cylinder suction phase, i.e. between O and S, whereas changes of state associated with this change, i.e. immediately preceding or immediately following changes of the state of the shut-off valve 24; 17, i.e. from open to closed or alternatively from closed to open, essentially take place outside the cylinder drawing phase, so that fuel supply regulation takes place essentially in conjunction with one of the changes of state of said shut-off valve 24; 17. As already mentioned, this is an advantage from an accuracy point of view. Had on the contrary a brief cut-off been made entirely during an ongoing fuel supply it would have been necessary to re-open the valve very rapidly in order to avoid a too large reduction of the fuel. However, such rapid precision control of valves is very difficult to perform. The method in accordance with the invention on the other hand makes it possible to considerably increase the length of the cut-offs of the fuel supply, which is very advantageous from a regulating point of view. Shut-off valves of this on-off type are very simple and functionally reliable and therefore it is an advantage to make use of this type of valve instead of varyable throttling. From a control point of view it is thus very advantageous to be able to affect the length of the cut-off progress, provided that this length is of reasonable extent. By arranging, in this case, for the cut-off to take place essentially during that portion of the engine revolution during which the intake passage is closed such reasonable extent of the cut-off progress is achieved. It is likewise possible to open a normally closed valve. In both types of valves it is essential to increase the period between changes of state with respect to the cut-off valve. This is achieved by arranging for the states of change to take place essentially within and outside, respectively, the suction phase as indicated above. The examples of control given in FIG. 4 relate to a two-stroke engine. The only difference therefrom with respect to a four-stroke engine is that the fuel supplies and consequently valve closures will occur half as often on account of the basic construction of the engine. In accordance with the examples given, the control of the fuel amounts have been performed at each possible occasion, i.e. in connection with each instance of fuel supply between O and S. However, this is not necessary. Instead it may in many cases be an advatange to perform adjustments more rarely. This is true particularly in crank case scavenged two-stroke engines or crank case scavenged four-stroke engines. In such cases the crank case can hold a considerable amount of fuel and consequently serves as a nivelling reservoir. In this manner it becomes possible to perform major fuel amount adjustments in two-stroke engines upon every other, every third or possibly every fourth engine revolution instead of upon each engine revolution and, in the case of a four-stroke engine, half as often. In other words the cut-off is not effected at each possible occasion but instead at every other or every third or possibly every fourth possible occasion. Possible occasion thus would be in connection with each fuel supply when the intake passages open, i.e. between O and S.

The opening and closing movements of the shut-off valve 24; 17 thus is controlled by the engine revolution position. This is effected in a mechanical-hydraulical or mechanical-pneumatical way. FIG. 2 illustrates a mechanical solution wherein the metering needle or the shut-off valve 17 closes off the entire fuel flow or a part flow on each possible occasion. FIGS. 3*a* and 3*b* illustrate the solution according to which the control is effected electrically. The shut-off valve 24 could be controlled for instance by a control computer so that cut-offs will take place to an essential extent during a part of the engine revolution when the intake passage is closed. In addition, it is quite simple to vary this control in such a manner that it does not take place on every possible occasion but instead on perhaps every other, every third or possibly every fourth possible occasion. In that case a major fuel amount adjustment is made instead. In consequence thereof it is no longer needed to activate the shut-off valve 24 as often, which leads to a considerable reduction of energy consumption, which is of great importance in many applications. In this case the control computer commands closure of valve 24 only on every other or every third or possibly every fourth possible occasion.

I claim:

1. A method of controlling the amount of fuel delivered to a combustion engine (1), wherein the fuel is supplied through an intake passage (2) intended to deliver air (3) and fuel (4) to one cylinder (5), said intake passage being opened and closed by a piston (6) and wherein the fuel supply to the intake passage (2) is effected upstream from the piston (6) and wherein, in response to the opening and closing of the intake passage (2), varying flow speeds and pressures are produced in the intake passage, the fuel supply system (8) being substantially affected by this variation and, in order to regulate the fuel supply to the engine, a cut-off takes place in the fuel-supply system (8) during a portion of the operating cycle by a shut-off valve (24; 17) which shuts off at least a part of the fuel flow, wherein a change of the state of the shut-off valve (24; 17) is arranged to take place during the cylinder suction phase, whereas a change of state associated with this change, essentially takes place outside the cylinder suction phase, so that fuel supply regulation takes place essentially in conjunction with one of the changes of state of said shut-off valve (24; 17).

2. A method as claimed in claim 1, wherein the shut-off valve (24; 17) is operable to shut off the entire fuel flow during a portion of the operating cycle to regulate the fuel supply to the engine.

3. A method as claimed in claim 1, wherein the fuel supply system (8) is a carburetor type (9) system.

4. A method as claimed in claim 1, wherein the cut-off is arranged to prevent fuel supply (34, 35) to the intake passage (2) caused by oscillation phenomena arising in connection with the closure of the intake passage by the piston.

5. A method according to claim 1, wherein the cut-off is arranged to start before the piston (6) has closed the intake passage (2), and is arranged to cease essentially before the piston (6) again begins to open the intake passage (2).

6. A method as claimed in claim 1, wherein the cut-off begins only after closure of the intake passage (2) by the piston (6), and wherein the cut-off ends only after the intake passage has again been opened by the piston (6).

7. A method as claimed in claim 1, wherein the cut-off is effected only on non-consecutive occasions.

8. A method as claimed in claim 1, wherein the shut-off valve (24) is operated electrically, and is of a normally open type, and wherein cut-off is effected by supply of current to the valve.

9. A device to control the amount of fuel supplied to an engine (1), wherein the fuel is delivered through an intake passage (2) intended to deliver air (3) and fuel (4) to one cylinder (5), said intake passage being opened and closed by a piston (6) and wherein the fuel supply to the intake passage (2) is effected upstream from the piston (6) and wherein, in response to opening and closing of the intake passage (2), varying flow speeds and pressures are produced in the intake passage, the fuel supply system (8) being operable to supply different amounts of fuel in response to the flow speeds and pressures in said intake passage and includes a shut-off valve (24; 17) which at least partially cuts off the fuel supply flow during a portion of the operating cycle, and a change of the state of the shut-off valve (24; 17) takes place during the cylinder suction phase whereas a change of state associated with this change essentially takes place outside the cylinder suction phase, so that fuel supply regulation takes place in conjunction with one of the changes of state of said shut-off valve (24; 17), and means for opening and closing the shut-off valve in response to the engine revolution position.

10. A device as claimed in claim 9, wherein the shut-off valve (24) is electrically controlled and is a normally open type of valve.

11. A device as claimed in claim 9, wherein the shut-off valve (24) is electrically controlled and closing of the shut-off valve is commanded only on non-consecutive occasions.

12. A device as claimed in claim 9, wherein the fuel supply system (8) is a carburetor (9) comprising at least one fuel supply line (25) leading to a low-speed nozzle and at least one fuel supply line (26) leading to a high-speed nozzle, said lines merge in a common line (26) and the shut-off valve (24) is arranged to shut off said common line (26).

13. A device as claimed in claim 9, wherein the fuel supply system (8) is a carburetor (9) comprising at least one fuel supply line (25) leading to a low-speed nozzle and at least one fuel supply line (26) leading to a high-speed nozzle, the shut-off valve is arranged to shut off both lines (25, 26) simultaneously.

* * * * *